US009857150B1

(12) United States Patent
Larson

(10) Patent No.: US 9,857,150 B1
(45) Date of Patent: Jan. 2, 2018

(54) SPLATTER TARGET AND METHOD OF MANUFACTURE

(71) Applicant: Cary Larson, Ham Lake, MN (US)

(72) Inventor: Cary Larson, Ham Lake, MN (US)

(73) Assignee: Splatterburst Targets LLC, Ham Lake, MN (US)

( * ) Notice: Subject to any disclaimer, the term of this patent is extended or adjusted under 35 U.S.C. 154(b) by 0 days.

(21) Appl. No.: 15/231,810

(22) Filed: Aug. 9, 2016

(51) Int. Cl.

| | |
|---|---|
| ***F41J 5/00*** | (2006.01) |
| ***F41J 1/01*** | (2006.01) |
| ***B41F 23/08*** | (2006.01) |
| ***F41J 5/24*** | (2006.01) |

(52) U.S. Cl.
CPC ..... *F41J 1/01* (2013.01); *B41F 23/08* (2013.01); *F41J 5/24* (2013.01)

(58) Field of Classification Search
CPC ..... F41J 5/24
USPC ..... 273/378, 403–408
See application file for complete search history.

(56) References Cited

U.S. PATENT DOCUMENTS

| | | | | |
|---|---|---|---|---|
| 3,895,803 | A * | 7/1975 | Loe | F41J 1/01 273/378 |
| 5,186,468 | A * | 2/1993 | Davies | F41J 1/01 273/378 |
| 5,188,371 | A * | 2/1993 | Edwards | F41J 1/01 273/378 |
| 5,580,063 | A * | 12/1996 | Edwards | F41J 1/01 273/378 |
| 6,019,375 | A * | 2/2000 | West, Jr. | F41J 1/01 273/378 |
| 7,631,877 | B2 * | 12/2009 | Zara | F41J 1/00 273/378 |
| 8,596,643 | B1 * | 12/2013 | Edwards | F41J 5/00 273/378 |
| 9,170,077 | B2 * | 10/2015 | Johnson | F41J 5/24 |
| 9,234,726 | B2 * | 1/2016 | Sharrock | F41J 5/24 |
| 9,625,239 | B2 * | 4/2017 | Flynn | F41J 5/00 |
| 2007/0046760 | A1 * | 3/2007 | Zara | F41J 5/22 347/105 |
| 2007/0262529 | A1 * | 11/2007 | Gamez | F41J 5/00 273/409 |
| 2016/0327377 | A1 * | 11/2016 | Flynn | F41J 5/205 |

* cited by examiner

*Primary Examiner* — Mark Graham
(74) *Attorney, Agent, or Firm* — Tysver Beck Evans

(57) ABSTRACT

A target device and method of manufacture includes providing a substrate with a printing surface upon which multiple coatings are deposited so as to provide a target image that allows for improved capacity for visually determining impact or penetration locations on the target image. The coatings include a first coating which defines target areas, with uncoated areas forming borderlines between and around the target areas. A transparent laminate of adhesive and a low dyne surface material is applied over the initial coating. Multiple layers of additional coatings having a variety of colorants are placed over the low dyne surface layer of the second coating to form the final target image. A projectile passing through the resulting target device will leave a halo of material around the impact site comprised of the first coating or the visible surface of the printing layer.

9 Claims, 13 Drawing Sheets

SPLATTER TARGET AND METHOD OF MANUFACTURE

FIELD OF THE INVENTION

The present disclosure describes targets, coatings for use in manufacturing targets and methods for manufacturing targets using a variety of material layers, which result in a target that includes at least one flake-off or release layer to provide improved visual indication of a successful impact or hit upon or through the target.

SUMMARY

Targets and target devices for use with firearms or other projectile weapons are well known and are used for recreational and training purposes. Targets are often painted or coated with a bright or contrasting surface to provide the target with improved visibility in order to allow an observer/user to more easily determine if and where the target has been struck.

Some targets such as those described in U.S. Pat. No. 7,631,877, issued on Dec. 15, 2009 and incorporated herein by reference, utilize multiple layers of materials including a release layer applied between a target substrate and an ink layer which defines the target image. The release layer acts to allow areas of the ink layer printed thereon, and adjacent to an impact point, to be released or flake off from the area around the impact so as to present a penetration hole which appears larger than the actual hole created through the target substrate. The use of a release layer(s) is that the tendency of the target indicia to flake off at and around a penetration site makes it difficult to discern the precise placement of a shot relative to adjacent regions of the target surface lacking additional visual cues.

To avoid such difficulty in determining shot location on the target surface, the present invention avoids the use of a release layer, and also employs a printing strategy which ensures that each discrete area of the target surface remains visually distinct even after the target is surface is marred by one or more projectiles passing therethrough.

DETAILED DESCRIPTION

Embodiments of this disclosure include target devices such as may be used in shooting sports, riflery training or marksmanship practice. Embodiments also include techniques and methods for manufacturing the target device and printing the target image.

Figure 1:
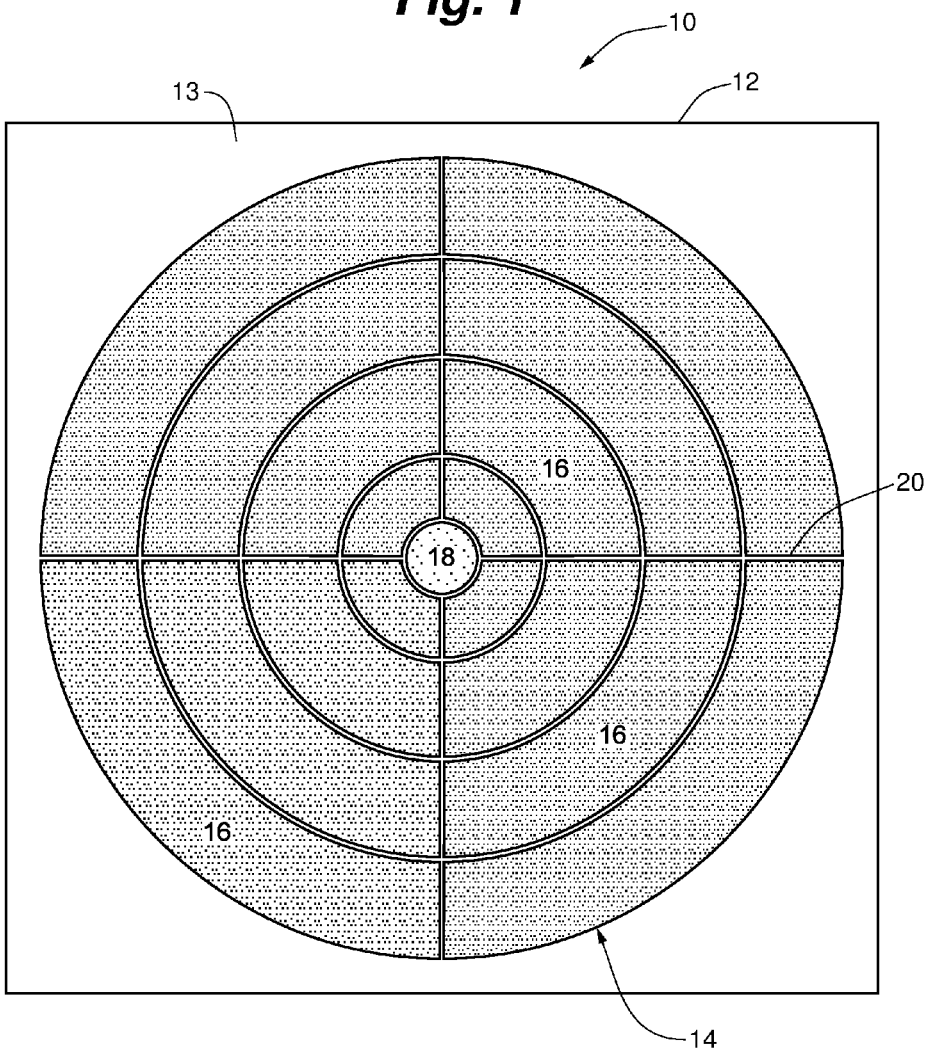
FIG. 1 is a front view of an embodiment of the invention comprising a target device.

Turning to FIG. 1, a representative embodiment of a target device or target 10 is shown. Target 10 comprises a base or substrate 12 upon which the target design or image 14 is printed. The image 14 may be of any pattern or sequence of geometric shapes, including one or more sequences of concentric rings, wedges, or any other pattern of target regions desired. In some embodiments the image 14 may be in the form of an animal's profile or shape. In some embodiments the target image is comprised of one or more primary target areas 18, also known as a "bullseye", with secondary target areas 16 adjacent thereto. In some embodiments each target area 16 and 18 is bordered by a distinct border "line" 20, which forms the overall pattern of the image 14.

In at least one embodiment, the substrate 12 is comprised of a base paper. The paper may be of any thickness or quality. In some embodiments the paper has a thickness of approximately eight points. In some embodiments the substrate is any type of paper, card board, corrugated material, wood, or other type of material (composite, layered or uniform), or any desired thickness, through which most common calibers and types of ballistic projectiles will readily pass when fired through a gun at the target 10. In some embodiments the substrate is a pressure sensitive material or includes a pressure sensitive component in its composition.

Figure 4:
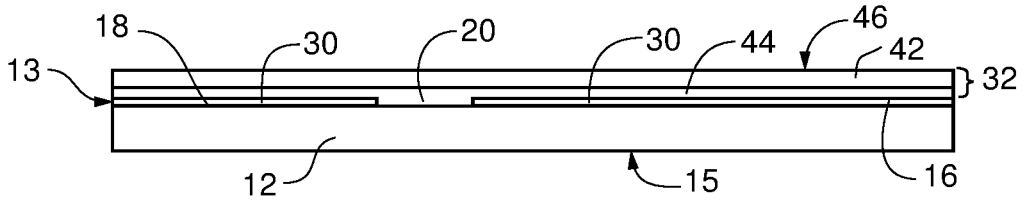
FIG. 4 is a cross-sectional view of a portion of the target device shown in FIG. 3*a* or 3*b*.

The substrate 12 include a printing surface 13, which may in some embodiments, include an inherent coating of material such as clay or other substances that provide a sheen, or a more uniform printing surface, upon which ink or other materials may be applied. Substrate 12 may include a backing surface 15 that may or may not include a coating (see FIG. 4).

In the present disclosure the printing and formation of the target image 14 is unique in that it forms an image which readily displays impact or penetration sites while maintaining sufficient integrity to also clearly show the placement of the impact within the target areas 16 and 18 while maintaining the visual representation of the border lines 20. This allows a viewer to quickly visually discern if a shot is entirely within a given region 16 or 18 of the target image 14 or of the shot has straddled multiple regions 16 or 18.

Figure 2:
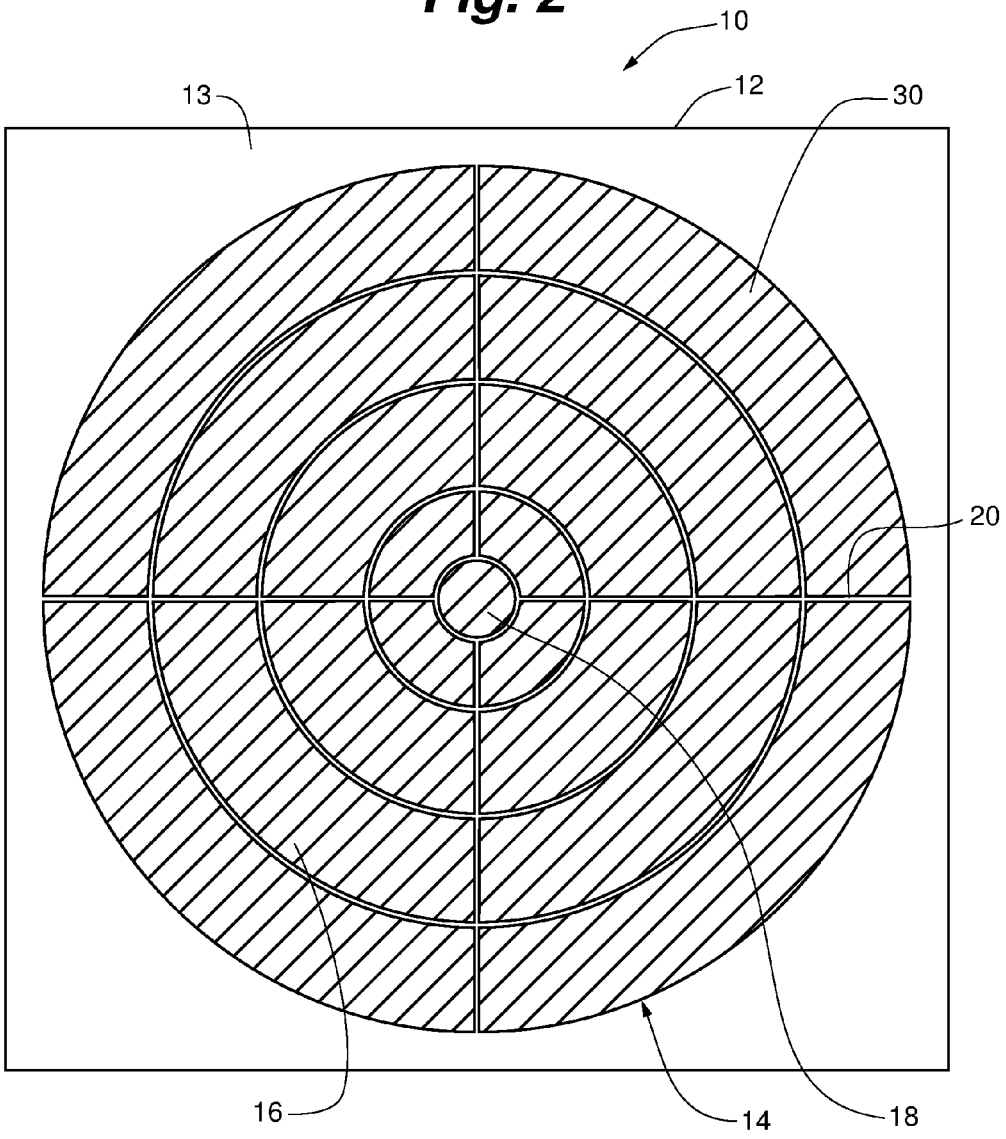
FIG. 2 is a front view of an embodiment of the target device shown following the deposition of a first coating thereon.

In order to provide this feature, the target image 14 is initially created by first placing or printing on the printing surface 13 of the substrate 12, a first coating 30 of brightly colored ink on all of the printing surface 13—except on the pattern corresponding to the border lines 20. An example of this initial printing step is shown in FIG. 2, where for purposes of illustration the regions 16 and 18 of the printing surface 13 that are coated with first coating 30 are shown with single line cross-hatching.

The ink of which the first coating 30 is comprised may be any color or style of ink or colorant. In at least one embodiment, the colorant of the first coating is selected to visually contrast with the colors of the fourth and fifth coatings (34 and 35) such as are described in greater detail below. In at least one embodiment the first coating 30 comprises an ink having a fluorescent color or affect. In at least one embodiment the first coating 30 comprises a water based, flexographic ink. The first coating 30 may be applied to the substrate 12 by any method of printing, painting or material deposition.

Figure 3A:
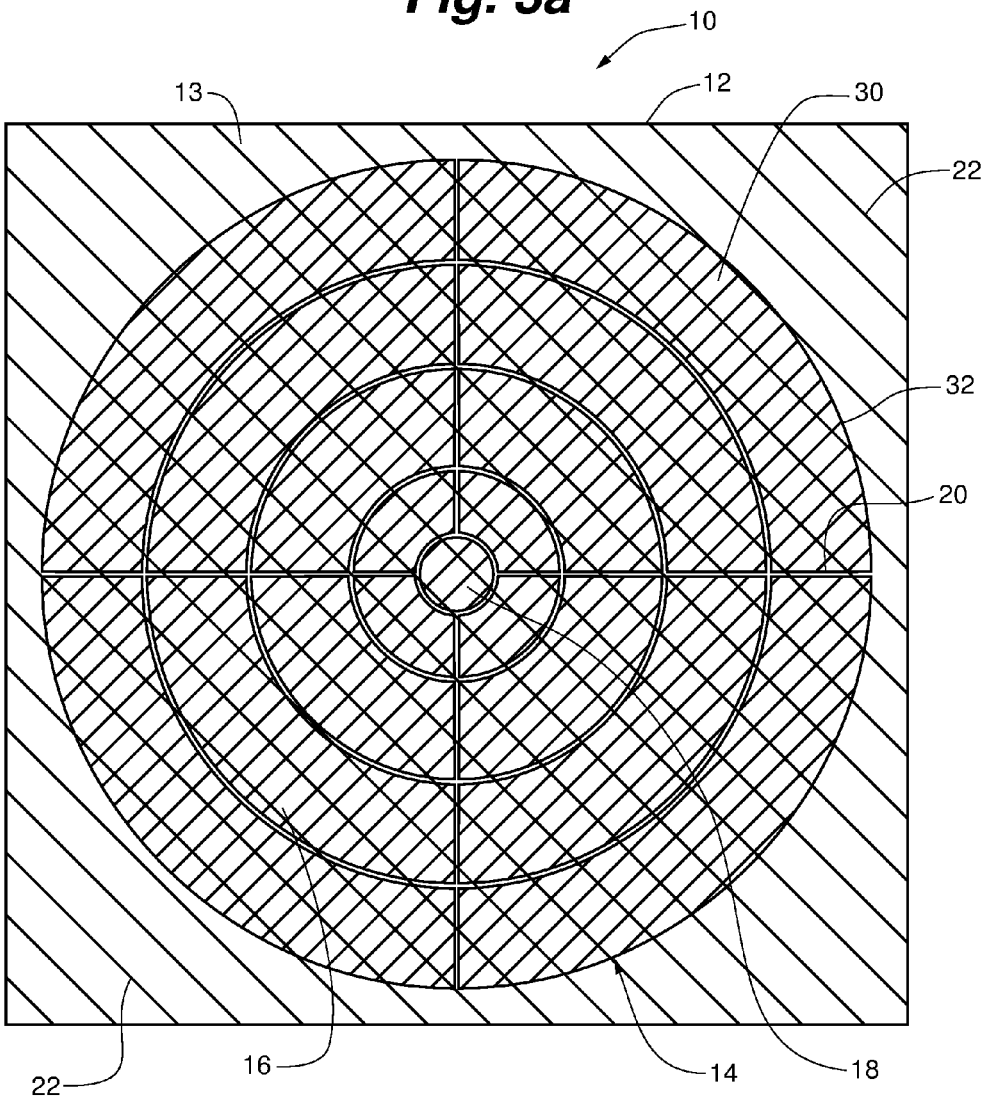
FIG. 3*a* is a front view of an embodiment of the target device shown following the deposition of a second coating thereon.
Figure 3B:
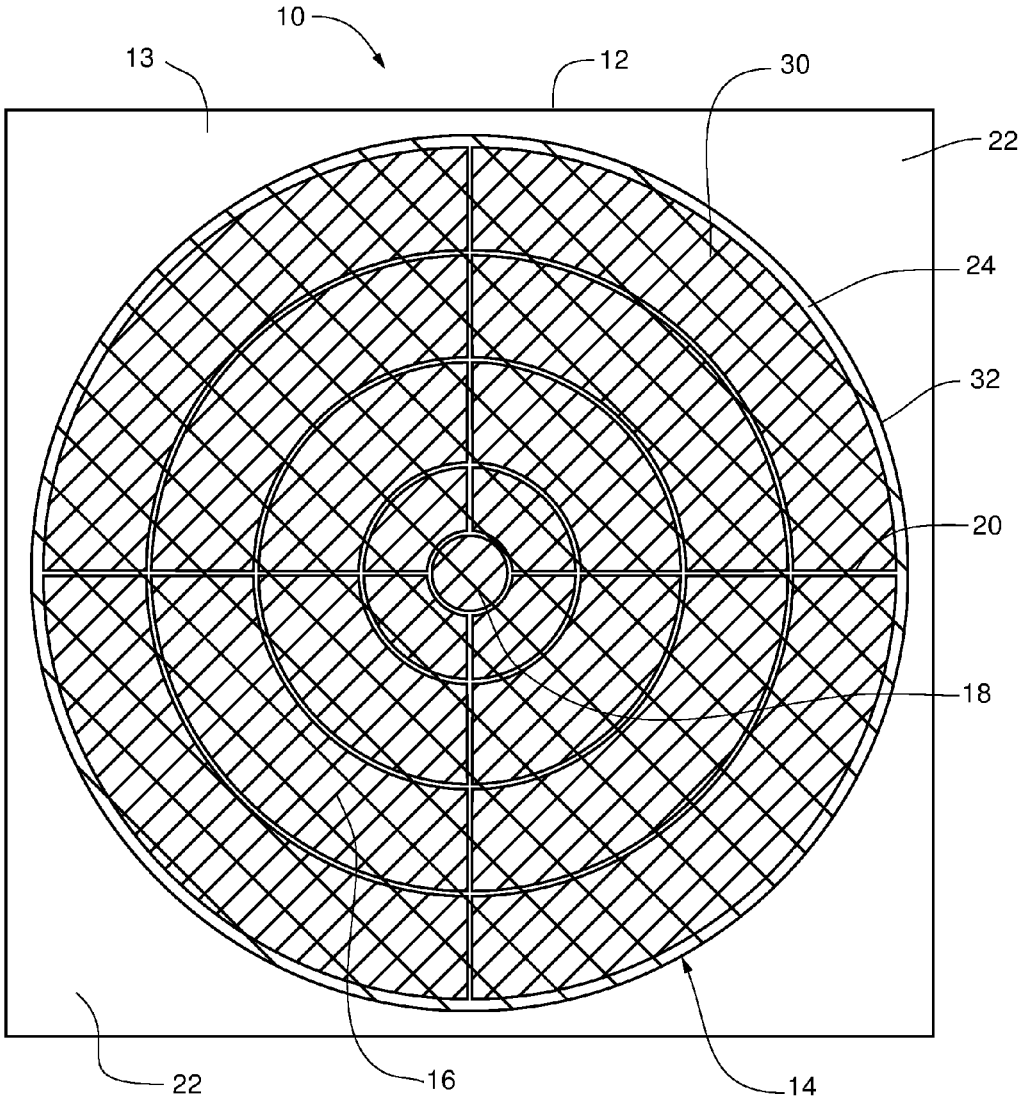
FIG. 3*b* is a front view of an alternative embodiment of the target device shown in FIG. 3*a* following the deposition of a second coating thereon.

As is shown in FIG. 3*a*, following the application of the first coating 30 to the selected regions 16 and 18 of the printing surface 13, a second coating 32 is applied over the entire area of the printing surface 13, including the areas already coated with first coating 30, as well as the as of yet coated areas comprising the border lines 20. The areas outside of the target image 16, that is to say the "corner" regions 22 of the quadrilateral shaped substrate 12 shown in the embodiment of in FIGS. 1-6, are likewise coated with the second coating 32. In some embodiments however, the corner regions 22 or other areas surrounding the target image 14 are not coated with the second coating. In some embodiments, an example of which is shown in FIG. 3*b*, border lines 20 extend around the target image 14 to provide an image border line 24 that is coated with second coating 32, but wherein the surrounding corner regions 22 remain un coated substrate. For purposes of illustration the second coating 32 is shown as single line cross-hatching perpendicular to that used to depict the first coating 30.

In should be recognized that the sheet of substrate material 12 may, like the image 14, be provided in any shape desired. The image 14 may cover the entire printing surface 13 of the substrate 12 or take up only a portion thereof. Thus the "corner" regions 22 which lie outside of the image 14 may likewise be of any shape or area. The term "corner" as used above should therefore not be construed as being limited in reference to any particular shape or area of limitation, but rather is being used to designate the areas of the substrate printing surface 13 that are part of the printing surface 13 but are visually distinct and exterior to the target image 14.

Returning to the application process, the second coating 32 comprises a transparent bi-axially oriented polypropylene (BOPP) film 42. As may be seen in FIG. 4, one side of the film 42 includes an adhesive or adhesive layer 44 which is placed against the uncoated border lines 20 and the regions 16 and 18 having the first coating 32 thereon. The adhesive 44 may be any type of adhesive, but in at least one embodiment it is a pressure sensitive adhesive. The BOPP film 42 is a low dyne film, which means it is difficult for materials to stick to it. Coating 32 may be a laminate of film 42 and adhesive 44, such that the naturally low dyne surface (no adhesive) 46 of the film 42 is exposed following the application of the second coating 32 to the printing surface. In some embodiments second coating 32 may be any form of release layer, temporary bond adhesive or other substance or combination of substances which will release from the target surface when abraded by the impact of a projectile.

Second coating 32 may be applied by any suitable application process. In at least one embodiment however, the second coating 32 is a transparent laminate film which is laid across the printing surface 13 of the substrate and then pressed against the substrate 12 to engage the adhesive 44 to the underlying printing surface 13 and first coating 30.

Figure 5:
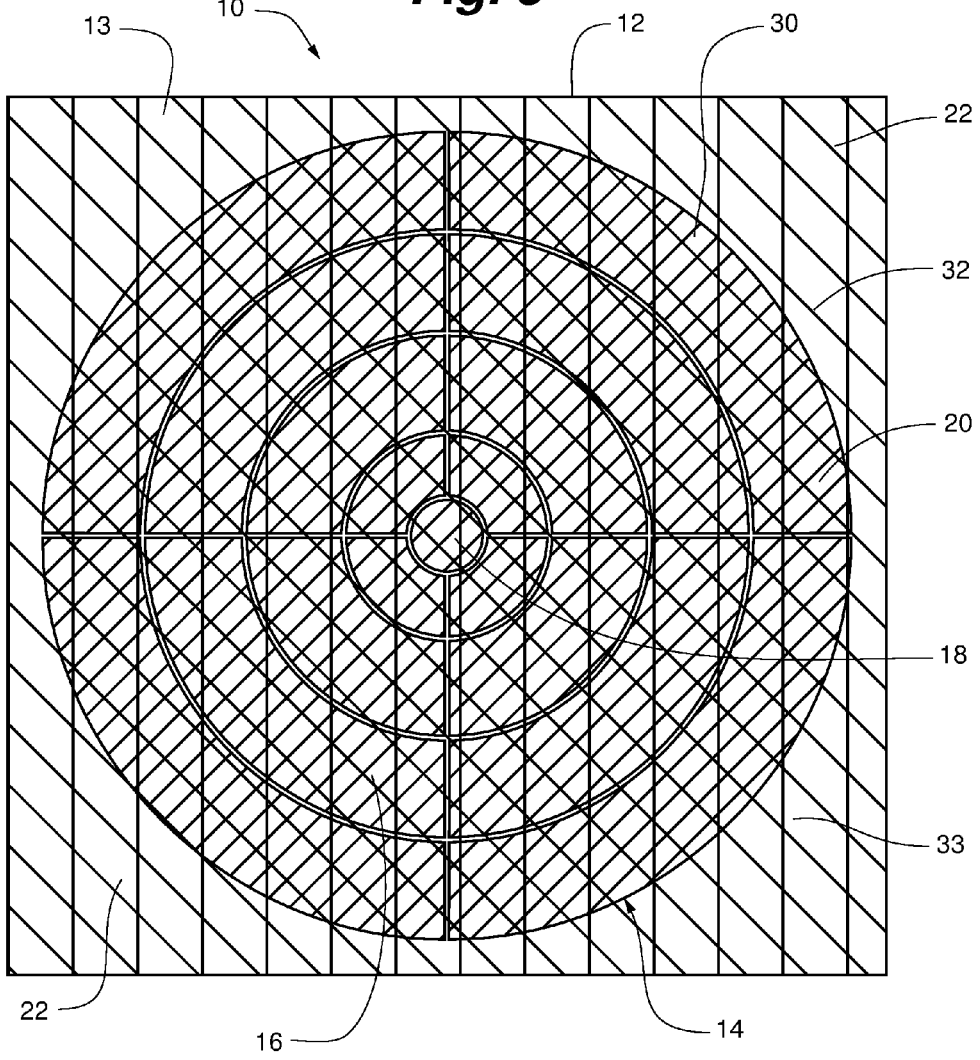
FIG. 5 is a front view of an embodiment of the target device shown following the deposition of a third coating thereon.
Figure 6:
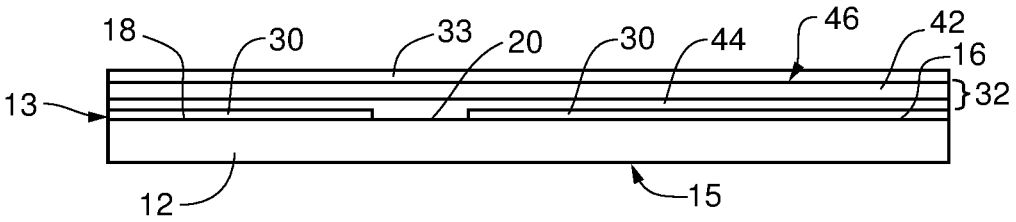
FIG. 6 is a cross-sectional view of a portion of the target device shown in FIG. 5.

Following the application of the second coating 32 to the entire printing surface 13 of the substrate 12, in the manner shown in FIG. 3*a* and described above; a third coating 33 is applied over the second coating 32 in the manner shown in FIGS. 5 and 6. In some embodiments, the second coating 32, is applied over the entire printing surface 13, in a manner similar to the application of the second coating 32 shown in FIG. 3*a*. To put it another way: wherever the second coating 32 has been applied, the third coating is applied over that area as well. In some embodiments, the third coating 33 is selectively applied only over the regions of the border lines 20 (and 24) such in the manner shown in FIG. 3*b*. For purposes of illustration, the third coating 33 is depicted in FIG. 5 as vertical line cross hatching.

The third coating 33 comprises an ink or colorant similar in composition to that of the first coating 30. In at least one embodiment the third coating 33 has the same composition as the first coating 30.

Following the application of the third coating 33, a fourth coating 34 and fifth coating 35 are selectively applied upon the third coating 33 to create and provide the external visualization of the target image 14. It should be noted that in embodiments where the third coating 33 is applied only over the regions of the target image 14 corresponding to the location of the border lines 20 (and 24) the third coating 33 may be applied before, after or simultaneously with the application of the fourth coating 34 and/or fifth coating 35.

Figure 7:
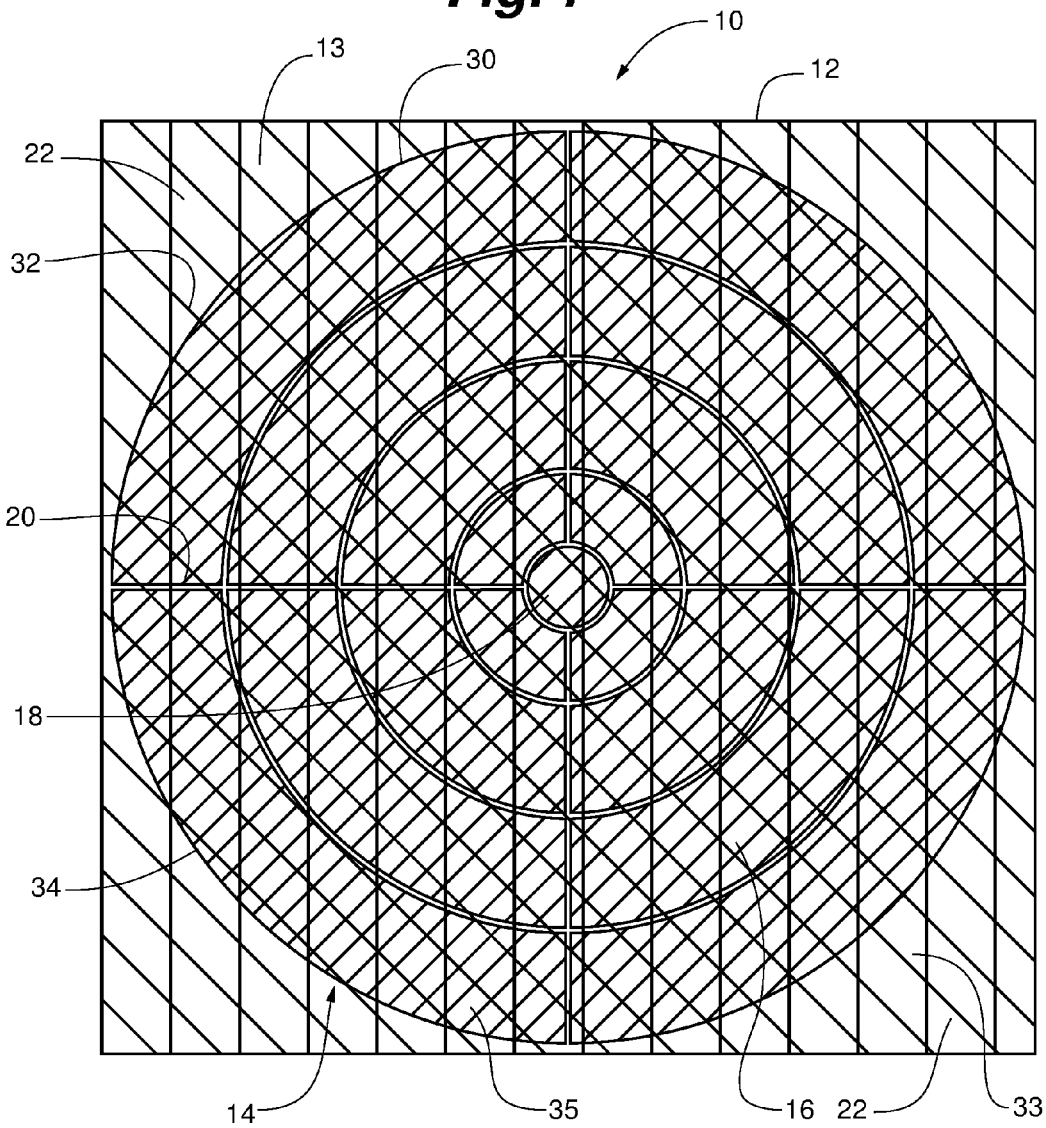
FIG. 7 is a front view of an embodiment of the target device shown following the deposition of a fourth coating and fifth coating selectively applied to discrete areas of the device.

An example application of a sequence of applying coatings 33, 34 and 35 is shown in FIGS. 7 and 8, wherein a fourth coating 34 is applied over a uniform third coating 33 so as to create the visually distinct primary target area 18 of the target image 14. In an embodiment where the primary target area 18 is a "bullseye", such as is depicted in FIG. 7, the fourth coating 34 may comprise an ink with a distinctive red coloring.

The fifth coating 35 comprises an ink having a different color than that of the fourth coating 34. The fifth coating 35 is selectively applied upon the third coating 33 to form the secondary target areas 16 of the target image 14. In the traditional "roundel style" target image 14, such as is shown in FIG. 7, the secondary target areas 16 are formed in the shape of a series of concentric circular rings, that are broken up into discrete target areas. In the embodiment shown each ring of the secondary target area 16 is formed by the uniform application of fifth coating 35 providing a single color to all aspects of the secondary target area 16. In some embodiments one or more rings, sections of rings or any regions of the secondary target area may be formed of any of a variety of similar or different colored inks.

Figure 8A:
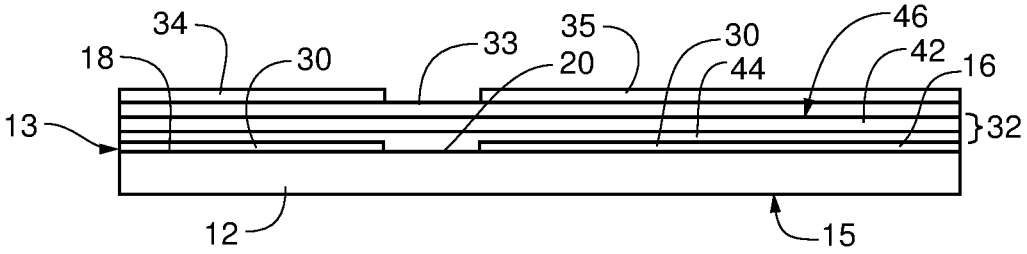
FIG. 8*a* is a cross-sectional view of a portion of the target device shown in FIG. 7.

As is shown in FIGS. 7 and 8*a*, between the visually distinct primary target region(s) 18 and secondary target regions 16, the border lines 20 remain coated only by coatings 32 and 33. Because third coating 33 is of a color visually distinct from both the fourth coating 34 and the fifth coating 35 the resulting target image 14 is provided with several visually distinct target regions that are readily apparent by visual inspection.

Figure 8B:
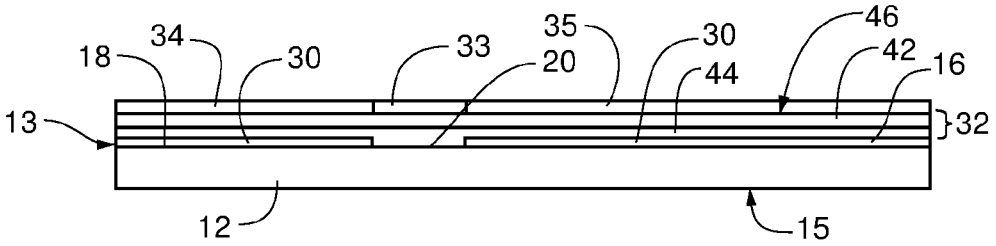
FIG. 8*b* is an alternative embodiment of the target device shown in FIG. 8*a*.

As mentioned above, in some embodiments the third coating 33 is not a flood application, but rather a layer selectively applied only to the areas of the target image 14 corresponding to the border lines 20. In such an embodiment, an example of which is shown in FIG. 8*b*, the third coating 33 is shown in between the primary target region 18 of fourth coating 34 and secondary target regions 16 of fifth coating 35 as opposed to underlying the fourth and fifth coatings as in the embodiment shown in FIG. 8*a*.

Figure 9:
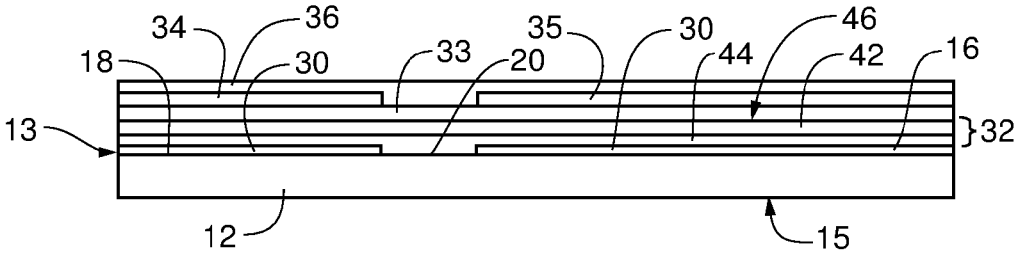
FIG. 9 is a cross-sectional view of a portion of the target device shown in FIG. 7 following the deposition of a sixth coating to surface of the device.

Once sufficient coatings of ink have been applied to form the primary 18 and secondary 16 target area of the target image 14, the entire surface of the target device 10 is coated with an overlay varnish or sixth coating 36. The overlay varnish is a transparent coating configured to provide protection to the target image 14 against incidental scuffs and scratches and its application is shown in FIG. 9. In at least one embodiment, the sixth coating 36 comprises a clear, water-based, flexographic overlay varnish. This sixth coating 36 may be applied in any manner desired, but in at least one embodiment is applied in a flood coating printing process.

Figure 10:
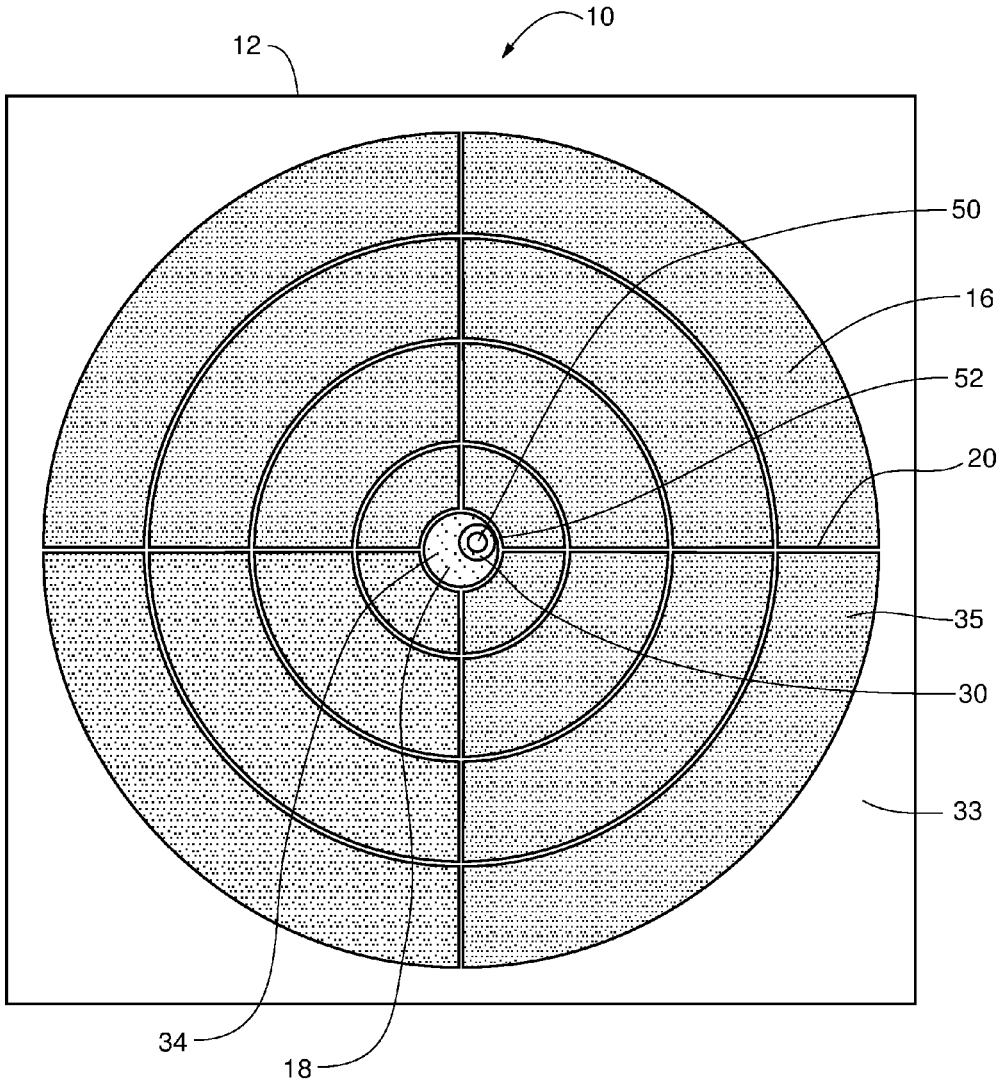
FIG. 10 is a front view of the embodiment shown in FIG. 1 wherein the target image has been penetrated by a projectile.
Figure 11:
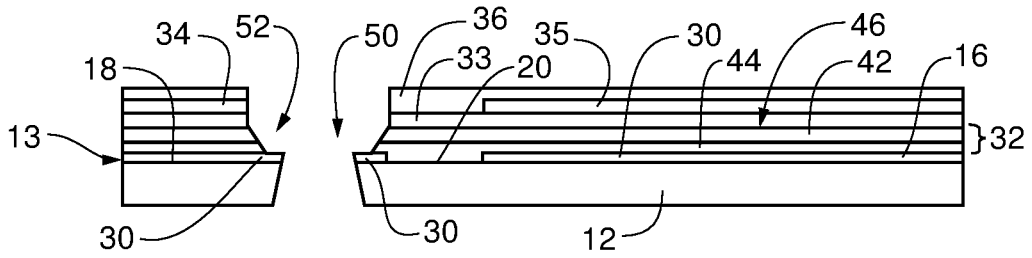
FIG. 11 is a cross-sectional view of a portion of the device shown in FIG. 10 focusing on the region of the device where the target image has been penetrated.

A key feature of the present disclosure is that the inks of the third coating 33, fourth coating 34 and fifth coating 35 are all placed on top of one another against the low dyne surface of the BOPP layer of the second coating 32 (not visible in FIG. 10). This arrangement, will result in the ready release of the third coating 33, and whichever top coating is applied thereupon (fourth coating 34 or fifth coating 35) in a region of the target where a significant physical impact or penetration occurs. As a result, when the target device 10, such as is shown in FIGS. 10 and 11, is fired upon and a hit is registered, the impact of the projectile will result in the third coating 33, and whichever of the fourth 34 and fifth 35 coatings are at the impact site 50, being abraded at and around the impact site 50. This creates a visually distinct opening where the respective coatings 33, 34, and/or 35 are removed and the contrasting color of the underlying first coating 30, forms a halo 52 around the impact site thereby making the impact site 50 visually apparent to even a distant observer.

An additional mechanism which aids in accurately identifying precisely where on the target image 14 an impact site 50 is located, even at a glance, is the presence of border lines 20. As previously mentioned border lines 20 surround each target area 16 and 18 of the target image 14. Border lines 20 share the color of the printing surface 13 of the substrate 12. In at least some embodiments, the color of the printing surface 13 is normally white or selected to be some other relatively bright color as compared to the color of the target areas 16 and 18 (see also the discussion of the fourth coating 34 and fifth coating 35 above). As discussed above, the regions of the printing surface 13 that correspond to the location of the border lines 20 are coated with the laminate second coating 32 and he third coating 33 of ink which is also selected to contrast the colors of the target areas 16 and 18.

Given the distinctive colors and layers of the border lines 20, in the event that an impact site 50 occurs near a border line 20, even if the third coating 33 applied thereto abrades away as a result of an impact, such as in the manner shown in FIG. 11; the border line 20 will still present a clearly contrasting color—that of the printing surface 13—relative to the color of the target areas 16 or 18 as well as being distinct from the color of the first coating 30 and second coatings 32. This feature ensures the ability of an observer to distinguish shot placement on the target image even if the impact site 50 is close to, or on the edge, of a given target area 16 or 18 even if all of the colored coatings 30, 33, 34, 35 are abraded away.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A target device comprising:

a substrate, the substrate having a printing surface, upon the printing surface is a target image, the target image being defined by a plurality of coatings comprising:

a first coating, the first coating comprising a colorant, the first coating is selectively deposited to define at least one primary target area and at least one secondary target area on the printing surface, regions of the printing surface located between the at least one primary target area and the at least one secondary target area comprise border lines;

a second coating, the second coating comprising a laminate film including an adhesive layer and a low dyne surface layer, the adhesive layer positioned over the printing surface, including the at least one primary target area, the at least one secondary target area and the border lines;

a third coating, the third coating comprising a colorant, the third coating uniformly deposited across the low dyne surface layer of the second coating;

a fourth coating, the fourth coating comprising a colorant, the colorant of the fourth coating defining a different color than the colorant of the first coating and the third coating, the fourth coating selectively deposited on the third coating in regions of the target image corresponding to only the at least one primary target area; and a fifth coating, the fifth coating comprising a colorant, the colorant of the fifth coating defining a different color than the colorant of the first coating, the third coating and the fourth coating, the fifth coating selectively deposited on the third coating in regions of the target image corresponding to only the secondary target area.

2. The device of claim 1, further comprising a sixth coating, the sixth coating comprising a varnish, the sixth coating being uniformly deposited over the entire printing surface, including the third coating, the fourth coating and the fifth coating.

3. The device of claim 1, wherein the first coating and the third coating have the same colorant.

4. The device of claim 3, wherein the colorant of the first coating is fluorescent.

5. The device of claim 3, wherein the colorant of the first coating provides a color which contrasts with that of the colorants of the fourth coating and the fifth coating.

6. The device of claim 1, wherein the first coating, the third coating, the fourth coating, and the fifth coating each comprise an ink.

7. The device of claim 6, wherein the ink is a flexographic ink.

8. The device of claim 1, wherein the printing surface is of a color different than that of first coating, the third coating, the fourth coating and the fifth coating.

9. The device of claim 1, wherein the low dyne surface layer of the second coating is a transparent film of BOPP material.

* * * * *